US006252522B1

(12) United States Patent
Hampton et al.

(10) Patent No.: US 6,252,522 B1
(45) Date of Patent: Jun. 26, 2001

(54) BILLBOARD CONSUMPTION MEASUREMENT SYSTEM

(75) Inventors: Gregory Dean Hampton, San Diego; Kamran Moallemi, Del Mar; Robert L. Warren, Cardiff, all of CA (US)

(73) Assignee: Solana Technology Development Corporation, San Diego, CA (US)

( * ) Notice: Subject to any disclaimer, the term of this patent is extended or adjusted under 35 U.S.C. 154(b) by 0 days.

(21) Appl. No.: 09/318,368

(22) Filed: May 25, 1999

Related U.S. Application Data

(60) Provisional application No. 60/087,020, filed on May 28, 1998.

(51) Int. Cl.[7] ..... G08G 1/09

(52) U.S. Cl. ..... 340/905; 340/933; 455/66; 455/517

(58) Field of Search ..... 340/905, 901, 340/908, 933, 936; 455/39, 42, 66, 517

(56) References Cited

U.S. PATENT DOCUMENTS 4,623,230 * 11/1986 Weinblatt ..... 351/210
5,214,793 * 5/1993 Conway et al. ..... 340/905
5,848,129 * 12/1998 Baker ..... 379/67.1
5,900,825 * 5/1999 Pressel et al. ..... 340/905
6,064,318 * 5/2000 Kirchner, III et al. ..... 340/905

* cited by examiner

*Primary Examiner*—Daniel J. Wu
(74) *Attorney, Agent, or Firm*—Barry R. Lipsitz; Douglas M. McAllister

(57) ABSTRACT

A system for measuring exposure to a visual display such as a billboard. A transmitter that is proximate to the billboard broadcasts a data signal that carries information relating to the billboard. This information may identify the location of the billboard, the message displayed by the billboard, and time of day. The data signal is provided at a power level that is adapted to reach a pre-defined exposure area in which the billboard can be viewed. A portable receiving device is provided to a defined consumer population to measure the exposure of the consumers to the billboards. The receiving device may be carried or worn by the consumer, or carried in the consumer's vehicle. The receiving device is adapted to recover the data signal and store the information relating to the billboard when the viewer is in the pre-defined exposure area. The time of day and duration of the exposure may also be recorded. The recorded information is subsequently downloading for processing by a central processing facility, e.g., via a telephone line or computer link.

25 Claims, 3 Drawing Sheets

BILLBOARD CONSUMPTION MEASUREMENT SYSTEM

This application claims the benefit of U.S. provisional patent application No. 60/087,020 filed on May 28, 1998.

BACKGROUND OF THE INVENTION

The present invention relates to a method and apparatus for measuring the exposure of consumers to billboard advertisements for the purpose of determining consumption, e.g., viewership. More particularly, the present invention provides a billboard advertisement consumption-measuring scheme that parallels efforts to measure audience consumption of radio and television broadcasts. Various techniques are disclosed for measuring the exposure of a consumer, whether in a vehicle or on foot, to a posted billboard or other external advertising means.

The present day consumer is almost continuously barraged by multiple advertising means. The proliferation of cable television channels, radio stations, web channels, and other electronic means is getting a lot of attention for the purposes of measuring audience reception.

There is, however, at least one channel that is not getting a great deal of attention for this purpose. This channel is that of billboards and other static visual advertising forms. Billboards are commonly posted externally, e.g., along roadsides, and on the exterior of buildings, for example, internally, e.g., in airports and train stations, and on mobile vehicles, e.g., busses.

In the past, the degree of consumer receipt of this media has been estimated by general correlation of demographic groups assumed to make up a traffic flow with traffic statistics. Any better measurement and refinement in the demographics has been deemed difficult and/or not cost effective.

The invention disclosed herein provides a practical and economical system for measuring the exposure (e.g., audience size) of consumers to specific billboards. The invention provides a system to resolve the time of consumer exposure to the billboard, to convey information in addition to a basic identification code if desired, and to consolidate the information of several consumers.

SUMMARY OF THE INVENTION

In accordance with the present invention, an apparatus is provided for measuring exposure to a billboard. A transmitter proximate to the billboard broadcasts a data signal that carries information relating to the billboard. The data signal is provided at a power level that is adapted to reach a pre-defined exposure area in which the billboard can be viewed. The data signal can contain information identifying the billboard and/or a location thereof. The data signal can also provide information regarding a time when the data signal is broadcast.

A receiver is carried by a potential viewer of the billboard for receiving the data signal. The receiver is adapted to recover the data signal and store the information relating to the billboard when the viewer is in the pre-defined exposure area. Clock data provided in the receiver or derived from the data signal is used to determine a duration over which the viewer is in the pre-defined exposure area.

In a preferred embodiment, the receiver comprises means for downloading the information stored therein for processing by a central processing facility. The receiver provides information identifying the viewer to the central processing facility.

The transmitter can comprise means for receiving a control signal from a central controller for defining the data signal carried in the beacon from the billboard.

A receiver apparatus is provided, which is adapted to be carried by a potential viewer for measuring exposure to a billboard. The receiver includes means for recovering a data signal broadcast by a transmitter proximate to the billboard when the potential viewer is in a pre-defined exposure area in which the billboard can be viewed. The data signal carries information relating to the billboard. Means are provided in the receiver apparatus for recovering and storing the billboard information. The data signal is provided at a power level that is adapted to reach a pre-defined exposure area.

Corresponding methods for measuring the consumption of billboard advertising are also provided.

DETAILED DESCRIPTION OF THE INVENTION

The number of channels or forms of communication that are available to reach the consumer is growing in such a manner as to be almost beyond a practical ability to measure the consumer's receipt of the message. Obviously, sales are the ultimate determinate of the effectiveness of the message delivered, but with such a proliferation of channels, any estimate of the effectiveness of each channel, e.g., of which channels are working or not, is increasingly unreliable.

The present invention attempts to resolve this ongoing challenge. Most consumers are exposed to billboards, but there has been no way to resolve who is exposed, and what impact that exposure might have on a purchase decision. For example, many consumers walk or drive past different billboards every day. However, even with annual revenue approaching two billion dollars, billboards enjoy the poorest demographic exposure details of any public media.

Conventionally, a "billboard" refers to a board or other flat surface on which a painting is made or a paper display is affixed, typically with glue. However, the term "billboard" is used broadly herein to encompass a conventional billboard as well as any other static or time varying visual display, including electronic video screens and other light-emitting displays. Moreover, both two- and three-dimensional displays are encompassed. A three-dimensional display may include an air balloon (e.g., blimp) with some visual message that is tethered to the ground or other stationary object.

Moreover, the billboard may convey a commercial, informational, or public service message, for example, or a visible object that does not directly convey a message.

The BCMS of the present invention provides a beacon for each billboard site that conveys some amount of information about the site. This beacon is received by a receiving device, which is associated with a specific consumer or consumer group. This receiver device can be a specifically manufactured item for receiving such signals, or could be integrated into a pager, portable telephone, briefcase or purse, wristwatch or other multi-purpose device, or even provided in shoes and clothing, for example. The receiver device may be worn or carried by an individual, or in a vehicle in which the individual is traveling, for example.

The beacon that is transmitted from the billboard site can convey one or more of the following type of information:

An identifier (ID) for the billboard's location;

An ID for the product or advertiser associated with the billboard;

Coupon-type information, such as an electric signal that the consumer can store and use to obtain a discount on a product;

Time-varying information, e.g., based on time of day, day of week, or so forth;

Information tailored for specific recipients, such as specific demographic groups; or Other specific information.

Figure 1:
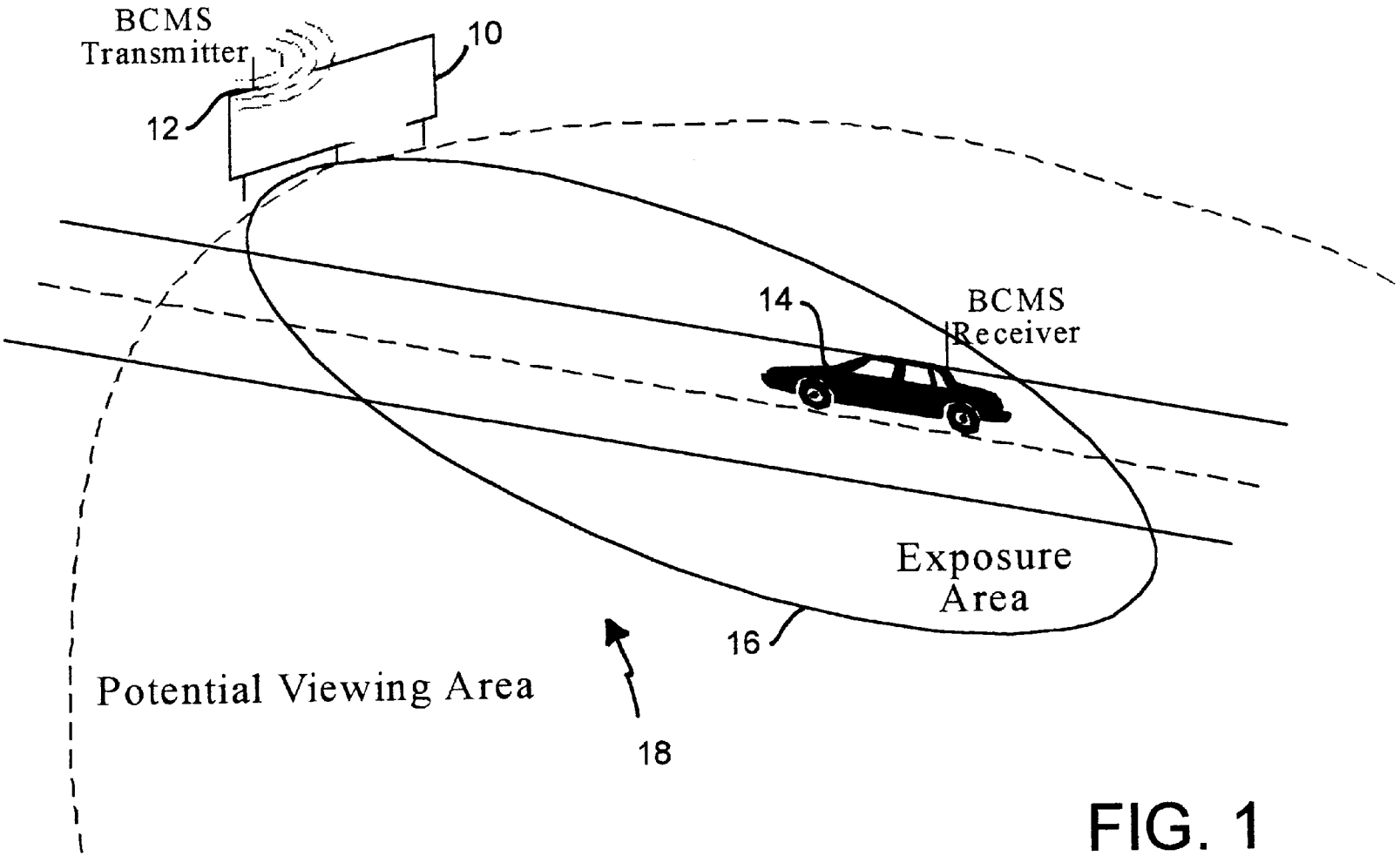
FIG. 1 illustrates a Billboard Consumption Management System (BCMS) in accordance with the present invention.

As shown in FIG. 1, the beacon is transmitted over a relatively small area around the billboard 10 by a conventional transmitter 12 so that the receipt of the signal is possible to those with a high likelihood of seeing the billboard, e.g., passengers in an automobile 14. The transmission range and broadcast area of the beacon may be designed to correspond roughly to a potential viewing area 18 in which the billboard can be viewed, or to a smaller exposure area 16. If the transmission range and area is by design smaller than the total potential viewing area, the beacon does not necessarily measure actual total consumption of the information. However, the beacon still provides information about the audience in greater detail than other measurement techniques that are available today.

It is important to note that the beacon can be any one or a combination of the following:

A specific frequency channel with the channel conveying information;

An on/off pattern, which conveys the information;

A carrier that carries specific modulated information; or

A carrier relying on some hidden data technique, such as that disclosed in commonly assigned U.S. Pat. No. 5,822,360 issued on Oct. 13, 1998 and entitled "Method and Apparatus for Transporting Auxiliary Data in Audio Signals."

The consumer receiving device (the "Device") may be similar to a pager or other small electronic device, such as wristwatch. In FIG. 1, and for purposes of example only, the Device takes the form of a BCMS receiver mounted in the automobile 14. As the Device enters an area in which a consumer could view a billboard (the "Exposure Area"), the Device receives and recovers the beacon signal that is broadcast from BCMS transmitter 12. In a preferred embodiment, the Device begins counting the time of exposure to the beacon. When the beacon strength drops below a preset (or adaptive) threshold, the recording end time is noted and the overall exposure duration is determined. For an adaptive threshold, it may be assumed, for example, that the consumer has left the exposure area when the signal strength reaches a fraction of the maximum signal strength level.

In the preferred embodiment, the carrier is a low power FM transmission. This allows for low cost transmission and reception equipment to be used. The FM signal carries a spread spectrum data channel, which conveys specific information in the signal. Even at low data rates, such as 50 bits per second, sufficient information can be conveyed to be useful and to provide a significant range of numbering for differentiation among all the possible billboard locations or advertisers.

In a larger scale billboard exposure measurement scheme of the present invention, the Device may capture the information from a set of billboard sites and store the information in a memory. At specific times, this collected information is provided to a centralized entity for consolidation with other consumer information, e.g., from other consumers. This consolidated information may then be combined with demographic information, other ratings information, or other pertinent information prior to being subjected to statistical analysis.

Figure 2:
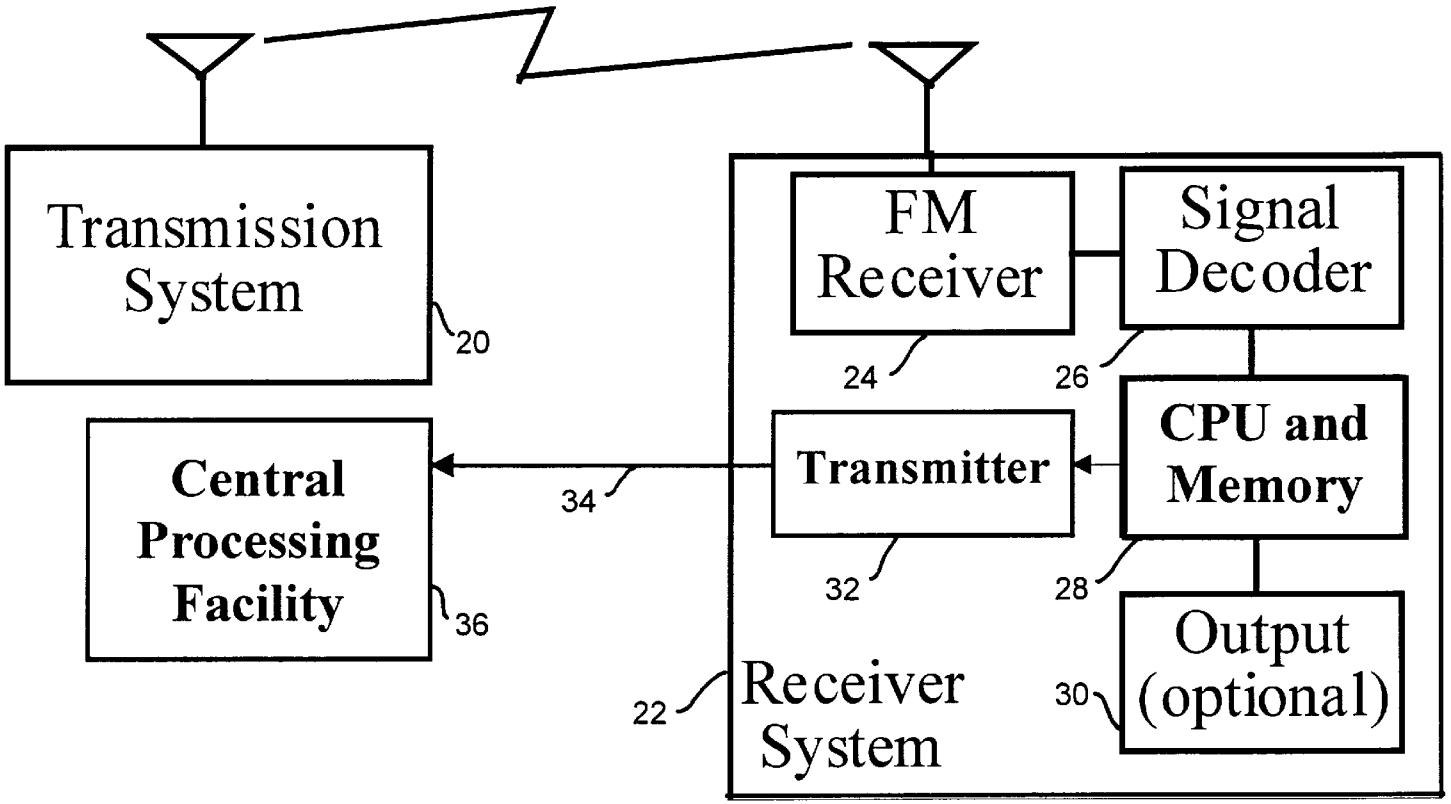
FIG. 2 illustrates a transmitter-receiver system diagram in accordance with the present invention.

The communication system is shown in schematic form in FIG. 2. The BCMS transmitter is represented by transmission system 20. A receiver system, generally designated 22, includes an FM receiver 24. It is noted that an FM receiver is depicted in the drawing only to illustrate a preferred embodiment. As will be appreciated, the transmitter/receiver system can use any type of communication technology, including analog and digital techniques.

The FM receiver shown in FIG. 2 receives the information signal transmitted by the transmission system 20, and passes it on to a signal decoder 26, which, in conjunction with a central processing unit (CPU) and memory component 28 recovers the billboard information from the received signal. The memory is provided to store the received information for later retrieval by a central processing facility 36 that analyzes exposure of the receiver system to billboards. The central processing facility can also include a reporting system for generating reports based on the data received from a plurality of receiver systems that have been deployed.

Communication of the stored data from the receiver system 22 to the central processing facility 36 is provided by a transmitter 32 and a communication channel 34. For example, the transmitter 32 can comprise a modem and the communication channel 34 can comprise a telephone line. Any other suitable type of transmission, including wireless RF or microwave techniques, could alternatively be used. An optional output 30, such as a display, can be used to provide messages to the user.

For purposes of explaining the invention, a specific example of information transfer from the billboard to the receiver system based on radio transmission will now be provided. The reader will note that this system can be applied to other transmission means, such as optical transmission, e.g., using infrared signals.

In the present example, a number of billboards along a roadway are equipped with a radio transmission system. Each radio transmission system includes a low power FM system carrying a low rate spread spectrum signal. The spread spectrum signal is used because it is noise-like, which reduces inappropriate detection, and does not jeopardize any reception equipment that may inadvertently lock on the FM signal.

A number of consumers are chosen for the purposes of audience measurement and are provided with small pager-like RF receiver devices. The devices may be worn or carried on or by the consumer, or on a vehicle in which the consumer travels, for example. The devices are used to receive the billboard transmissions, and are designed to be portable and functional, whether in a vehicle on a roadway or being carried by a pedestrian.

As the Device passes by a transmitting billboard, it counts the length of time it is exposed to the transmission and decodes the information carried by the transmission. For example, the information may include identification codes for the billboard and for the advertiser whose message is displayed in the billboard. As the Device passes out of the exposure area, the amount of time of total exposure is determined and stored with the two identification codes. This is shown in block diagram form in FIG. 3.

Figure 3:
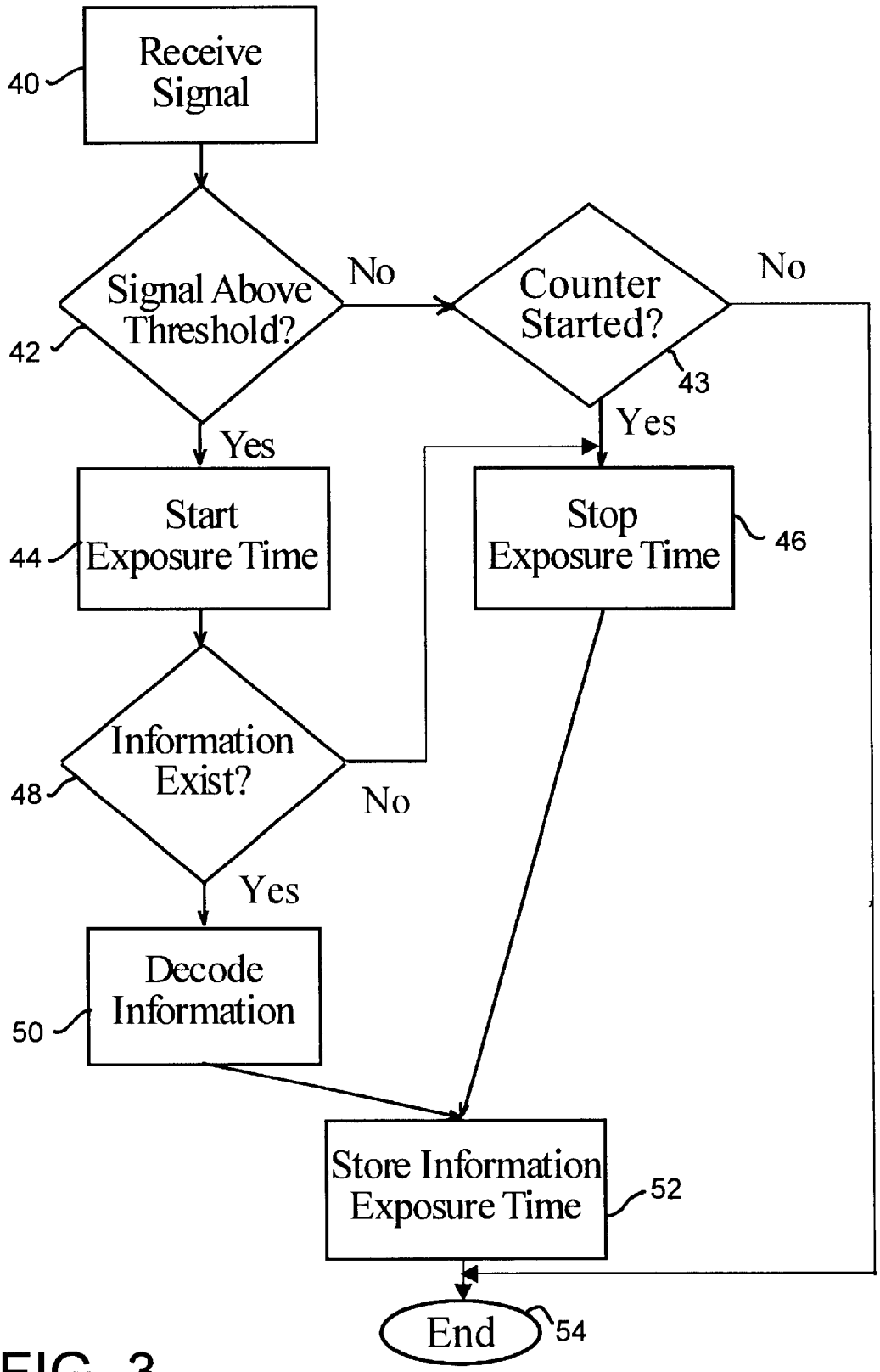
FIG. 3 illustrates a process flow for a receiver device in accordance with the present invention.

With reference to FIG. 3, the billboard information signal is received by the Device as indicated at box 40. At box 42, a determination is made as to whether the received signal is above a threshold (e.g., in signal strength). If so, an exposure time counter is commenced as indicated at box 44. A determination is made at box 48 as to whether information exists in the received signal. If so, the information is decoded (box 50) and the decoded information is stored together with the exposure time, as indicated at box 52.

In the event that the received signal is not above the required threshold (box 42), and the exposure time counter has been started as determined at box 43, the exposure time counter is stopped as indicated at box 46, and information as to this occurrence is stored (box 52) for possible later analysis. The exposure time counter is also stopped if no information is found to exist in the received signal, as determined at box 48.

In the event that the received signal is not above the required threshold (box 42), and the exposure time counter has not been started, the routine will end at box 54. The routine will also end at box 54 after any exposure time information has been stored at box 52.

The information may, for example, be collected by the Device over the period of a week. At the conclusion of the collection period, the information is transmitted to an information collection agency. This transmission can be performed by sending the entire Device to the collection agency, or by downloading the stored information over a phone line, transmitting via a computer link, or transmitting via a wireless connection link.

Many variations of the present invention are possible. These might be, for example, variations on the preferred embodiment, or options that might apply in some applications only. These variations include:

The potential to measure viewership of an event such as an outdoor seminar or concert, which is tied to a sponsor.

The beacon signal may include specific information, including coupon, rebates, or club points similar to frequent flier awards. With this scheme, a consumer is rewarded for repeatedly viewing a billboard.

Groups of recipients (e.g., specific demographic groups) can be targeted for specific treatment.

The beacon transmission can be low level radio frequency (RF), infrared (IR) or acoustic. If RF, the channel can be in any of the bands and can make use of existing channels. For example, low power channels in the paging frequencies can be used such that a pager device can rely on a single RF channel.

A beacon signal that changes as the contents of the billboard changes. An example would be multi-part billboards at ball games, which rotate periodically to display a new message, or electronic displays which can also change periodically. The beacon signal and/or the information contained therein can change according to the change in the billboard's display.

A means to determine if the consumer is approaching the billboard (i.e., facing it) or leaving it (i.e., not facing it). A directional antenna in the consumer's receiving device may be used for this purpose.

A means to determine the distance (e.g., range) of the consumer from the billboard. A circuit that determines the power level of the broadcast signal may be used.

A directional system that cuts down on errant reception.

The ability to combine results of the billboard consumption management system with other audience measurement systems. For example, the ability to compile radio audience measurements with vehicular based billboard consumption.

A means to determine the amount of time that a consumer is exposed to the billboard, rather than just the ability to detect number of exposures.

A means for manually recording exposure to the billboard, e.g., for specific recall of a product or merchant, capture of specific points, or for other purposes. For example, the consumer may activate a button on the receiving device for this purpose. The receiving device may allow the consumer to activate the button only once within a given time period, e.g., once a day.

The device can be two-way, e.g., a receiver-transmitter. That is, it can also provide the feedback of collected data via some wireless or wired channel to a receiver that is located, e.g., near the billboard.

The transmission system may contain multiple carriers, whether divided in time, frequency, or coding, and the information may be selectively retrieved. For example, a system may be provided wherein a spread spectrum carrier with one code channel carries the billboard information, while another spread spectrum carrier carries product-specific information. Moreover, some receiver devices may be capable of receiving one or more of the data channels, e.g., based on the consumer's demographic characteristics.

The BCMS transmission system may include a remote link for updating the transmitted information, e.g., from the billboard to a central processing facility. Such link may be wireless, wireline, or local updateable memory (i.e., with computer or removable memory).

It should now be appreciated that the present invention provides a novel approach to measuring exposure to and consumption of billboard advertising. A transmitter is located at the billboard for providing a beacon to consumer receivers that pass through the vicinity of the billboard. The consumer receiver obtains and stores information indicative of the exposure to the billboard and the duration of the exposure. This stored information is downloaded or transmitted by the consumer receiver (e.g., on a periodic basis) to a central facility for analysis.

Although the invention has been described in connection with various preferred embodiments, it should be appreciated that numerous adaptations and modifications may be made thereto without departing from the scope of the invention as set forth in the claims.

What is claimed is:

1. An apparatus for measuring exposure to a billboard, comprising:

a transmitter proximate to said billboard for broadcasting a data signal that carries information relating to said billboard for use in measuring exposure to said billboard; wherein:

said data signal is provided at a power level that is adapted to reach a pre-defined exposure area in which said billboard can be viewed.

2. The apparatus of claim 1, wherein:

said data signal identifies said billboard.

3. The apparatus of claim 1, wherein:

said data signal identifies a location of said billboard.

4. The apparatus of claim 1, wherein:

said data signal provides information regarding a time when the data signal is broadcast.

5. The apparatus of claim 1, further comprising:

a receiver associated with a potential viewer of the billboard for receiving said data signal; wherein:

said receiver is adapted to recover said data signal and store said information relating to said billboard when the potential viewer is in said pre-defined exposure area.

6. The apparatus of claim 5, wherein:

said information comprises clock data; and said receiver is responsive to said clock data for determining a duration in which the potential viewer is in the pre-defined exposure area.

7. The apparatus of claim 5, wherein:

said receiver comprises means for downloading said information for processing by a central processing facility.

8. The apparatus of claim 7, wherein:

said receiver provides information identifying said potential viewer to said central processing facility.

9. The apparatus of claim 7, wherein:

said transmitter comprises means for receiving a control signal from a central controller for defining said data signal.

10. A receiver apparatus adapted to be carried by a potential viewer for measuring exposure to a billboard, comprising:

means for recovering a data signal broadcast by a transmitter proximate to said billboard when the potential viewer is in a pre-defined exposure area in which said billboard can be viewed;

said data signal carrying information relating to said billboard for use in measuring exposure to said billboard; and means for storing said information; wherein:

said data signal is provided at a power level that is adapted to reach a pre-defined exposure area.

11. The apparatus of claim 10, wherein:

said data signal identifies said billboard.

12. The apparatus of claim 10, wherein:

said data signal identifies a location of said billboard.

13. The apparatus of claim 10, wherein:

said data signal provides information regarding a time when the data signal is broadcast.

14. The apparatus of claim 10, wherein said information comprises clock data, further comprising:

means for processing said clock data to determine a duration in which the potential viewer is in the pre-defined exposure area.

15. The apparatus of claim 10, further comprising:

means for downloading said information for processing by a central processing facility.

16. The apparatus of claim 10, further comprising:

means for providing information identifying said potential viewer to said central processing facility.

17. A method for measuring exposure to a billboard, comprising the step of:

broadcasting a data signal from a transmitter proximate to a billboard at a power level that is adapted to reach a pre-defined exposure area in which said billboard can be viewed; wherein:

said data signal carries information relating to said billboard for use in measuring exposure to said billboard.

18. The method of claim 17, wherein:

said data signal identifies said billboard.

19. The method of claim 17, wherein:

said data signal identifies a location of said billboard.

20. The method of claim 17, wherein:

said data signal provides information regarding a time when the data signal is broadcast.

21. The method of claim 17, comprising the further step of:

receiving said data signal at a receiver associated with a potential viewer;

recovering said data signal at said receiver; and storing said information relating to said billboard at said receiver when the potential viewer is in said pre-defined exposure area.

22. The method of claim 17, wherein said information comprises clock data, comprising the further step of:

using said clock data to determining a duration in which the potential viewer is in the pre-defined exposure area.

23. The method of claim 17, comprising the further step of:

downloading said information from said receiver for processing by a central processing facility.

24. The method of claim 17, comprising the further step of:

providing information identifying said potential viewer from said receiver to said central processing facility.

25. The method of claim 17, comprising the further step of:

providing a control signal from a central controller to said transmitter for defining said data signal.

* * * * *